US008514666B2

(12) United States Patent
Zhang et al.

(10) Patent No.: US 8,514,666 B2
(45) Date of Patent: Aug. 20, 2013

(54) ELECTRONIC DEVICE WITH TIME UPDATE FUNCTION AND TIME UPDATE METHOD

(75) Inventors: Ju-Yuan Zhang, Shenzhen (CN); Zhang-Yong Zheng, Shenzhen (CN); Bi-Qing Luo, Shenzhen (CN); Xin Lu, Shenzhen (CN); Shih-Fang Wong, New Taipei (TW)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 163 days.

(21) Appl. No.: 13/191,474

(22) Filed: Jul. 27, 2011

(65) Prior Publication Data

US 2012/0188853 A1 Jul. 26, 2012

(30) Foreign Application Priority Data

Jan. 26, 2011 (CN) ..... 2011 1 0028528

(51) Int. Cl.
*G04C 11/00* (2006.01)

(52) U.S. Cl.
USPC ..... 368/47

(58) Field of Classification Search
USPC ..... 368/46–47, 327
See application file for complete search history.

(56) References Cited

U.S. PATENT DOCUMENTS

| | | | | | |
|---|---|---|---|---|---|
| 5,363,348 | A * | 11/1994 | Damle | 368/47 |
| 5,469,411 | A * | 11/1995 | Owen | 368/47 |
| 5,794,205 | A * | 8/1998 | Walters et al. | 704/275 |
| 5,825,871 | A * | 10/1998 | Mark | 379/357.03 |
| 6,373,374 | B1 * | 4/2002 | Siemens | 340/309.8 |
| 6,717,598 | B1 * | 4/2004 | Melton et al. | 715/846 |
| 7,167,417 | B2 * | 1/2007 | Akahane et al. | 368/47 |
| 7,821,876 | B2 * | 10/2010 | Frantz | 368/47 |
| 7,916,579 | B1 * | 3/2011 | Treyz et al. | 368/10 |
| 8,185,770 | B2 * | 5/2012 | Siemens et al. | 713/500 |
| 8,194,506 | B2 * | 6/2012 | Luk | 368/47 |
| 2011/0292769 | A1 * | 12/2011 | Snider et al. | 368/47 |

* cited by examiner

*Primary Examiner* — Sean Kayes
(74) *Attorney, Agent, or Firm* — Altis Law Group, Inc.

(57) ABSTRACT

An electronic device with time update function includes a radio module, a clock module, an audio input port, a storage module, and a processing module. The radio module receives and outputs audible signals from the broadcasts of a broadcasting station. The audio input port receives audible sound generated by the radio module, and the clock module provides a source of real time. The processing module determines whether the signals received by the audio input port include current time information, and if so whether the system time is consistent with the current time information. The processing module updates the stored initial time with the current time information and adjusts the system time as necessary. A time update method is also provided.

7 Claims, 2 Drawing Sheets

ELECTRONIC DEVICE WITH TIME UPDATE FUNCTION AND TIME UPDATE METHOD

BACKGROUND

1. Technical Field

The present disclosure relates to electronic devices, and particularly, to an electronic device with a time update function and a method thereof.

2. Description of Related Art

The system time of electronic devices, for example, mobile phones, may become inconsistent with a standard time due to internal and external factors, for example, temperature. The electronic devices often cannot automatically adjust their system time, and this lack of adjustment function needs to be filled.

BRIEF DESCRIPTION OF THE DRAWINGS

Many aspects of the present disclosure should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail, with reference to the accompanying drawings.

Figure 1:
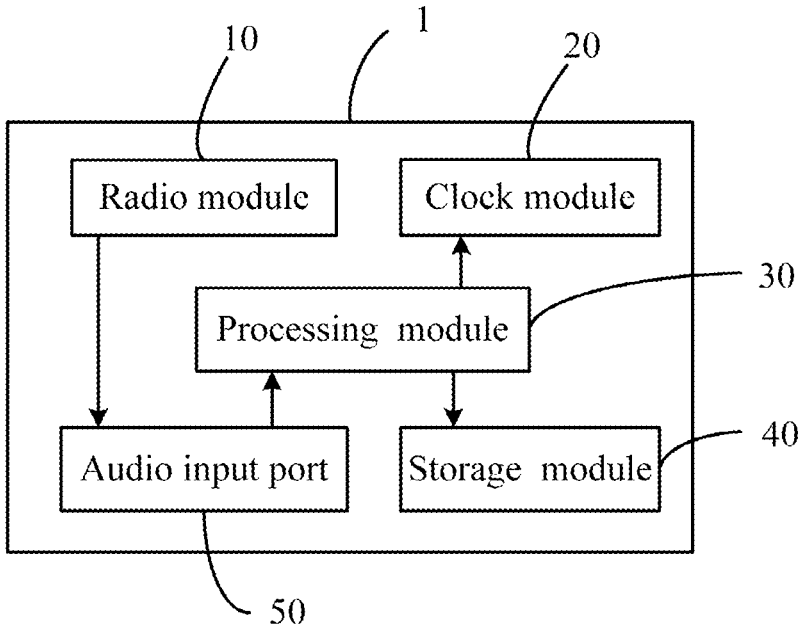
FIG. 1 is a block diagram of an electronic device in accordance with an exemplary embodiment.

Referring to FIG. 1, an electronic device 1 with a time update function includes a radio module 10, a clock module 20, a processing module 30, a storage module 40, and an audio input port 50. The radio module 10 receives signals broadcast from a broadcasting station (not shown) and outputs the received broadcast signals as audible sound (audio signals). The audio signals generated by the radio module 10 can be input to the electronic device 1 through the audio input port 50. In this embodiment, the broadcast signals from the station may include current time information which is audible, such as in form of beeps, and the signals of a certain type and frequency which contain the current time information (frequency information) is different from that of audio signals containing no current time information and can be recognized by the processing module 30. The clock module 20 provides a source of real time for the electronic device 1. The clock module 20 may be a real time clock (RTC) oscillator. The storage module 40 stores an initial time. The processing module 30 determines the system time according to the real time provided by the clock module 20 and the stored initial time. The processing module 30 determines whether the audio signals received by the audio input port 50 include current time information according to the frequency information of the audio signals. If the current time information is included, the processing module 30 determines whether the system time of the electronic device 1 is consistent with the current time information received from the broadcasting station, and, if it is inconsistent, replaces the initial time and stores the current time information in its place to adjust the system time. In this embodiment, the processing module 30 can automatically turn on or turn off the radio module 10. In particular, the processing module 30 may automatically turn on the radio module 10 for a predetermined time when the system time is proximate to the hour changing, for example proximate to 9:00 am or pm.

Figure 2:
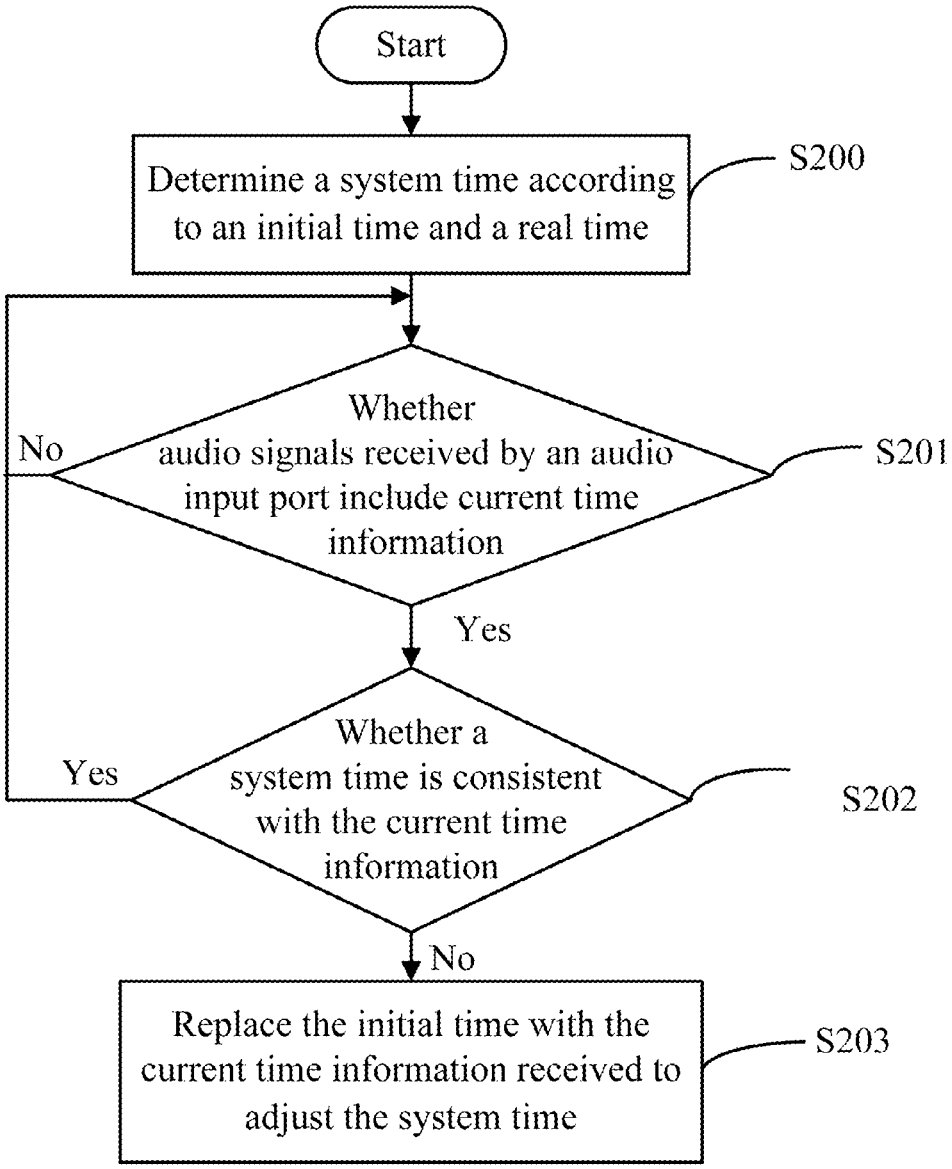
FIG. 2 is a flowchart of a time update method in accordance with an exemplary embodiment.

FIG. 2 is a flowchart of a time update method in accordance with an exemplary embodiment.

In step S200, the processing module 30 determines the system time according to the stored initial time and the source of real time in the electronic device.

In step S201, the processing module 30 determines whether the audio signals received by the audio input port 50 include the current time information. If they do, the procedure goes to step S202, otherwise the processing module 30 repeats step S201.

In step S202, the processing module 30 determines whether the system time is consistent with the current time information received. If yes, the procedure returns to step S201, otherwise the procedure goes to step S203.

In step S203, the processing module 30 replaces the initial time with the current time information received, to adjust the system time.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. An electronic device with a time update function, comprising:

a radio module configured for receiving signals broadcast from a broadcast station and outputting the received broadcast signals as audible audio signals;

an audio input port configured for receiving the audible audio signals generated by the radio module;

a clock module configured for providing real time;

a storage module configured for storing an initial time; and a processing module configured for determining a system time according to the stored initial time and the real time provided by the clock module, determining whether the audible audio signals received by the audio input port comprise current time information, and determining whether the system time is consistent with the current time information if the audible audio signals from the audio input port comprises current time information, the processing module further replacing the initial time with the current time information to adjust the system time if the system time is inconsistent with the current time information.

2. The electronic device as described in claim 1, wherein frequency information of the audible audio signals comprising current time information is different from that of audible audio signals containing no current time information and can be recognized by the processing module.

3. The electronic device as described in claim 2, wherein the processing module determines whether the audible audio signals received from the audio input port comprises current time information according to frequencies information of the audible audio signals.

4. The electronic device as described in claim 1, wherein the clock module is a real time clock oscillator.

5. The electronic device as described in claim 1, wherein the processing module is further configured for automatically turning on or turning off the radio module.

6. The electronic device as described in claim 5, wherein the processing module turns on the radio module for a predetermined time when the system time is proximate to hour changing.

7. A time update method applied in an electronic device, the electronic device comprising a radio module, a clock module, a storage module, and an audio input port, the radio module receiving and broadcasting broadcast signals from a broadcast station, the audio input port receiving audible audio signals generated by the radio module, the storage module providing an initial time, the clock module providing real time, the method comprising:

determining the system time of the electronic device according to the stored initial time and the real time provided by the clock module;

determining whether audible audio signals received by the audio input port comprise current time information;

determining whether the system time of the electronic device is consistent with the current time information if the audible audio signals comprises current time information; and replacing the initial time with the current time information to adjust the system time if the system time is inconsistent with the current time information.

* * * * *